US010589295B2

(12) United States Patent
Sarchi et al.

(10) Patent No.: US 10,589,295 B2
(45) Date of Patent: Mar. 17, 2020

(54) APPARATUS AND PROCESS FOR SEPARATING A SOLIDS/FLUID MIXTURE

(71) Applicant: Biochemtex S.p.A., Tortona (IT)

(72) Inventors: Paolo Sarchi, Serravalle Scrivia (IT); Ezio Giungato, Tortona (IT); Giuseppina Boveri, Tortona (IT)

(73) Assignee: Versalis S.p.A., San Donato Milanese (Milan) (IT)

( * ) Notice: Subject to any disclaimer, the term of this patent is extended or adjusted under 35 U.S.C. 154(b) by 0 days.

(21) Appl. No.: 16/074,096

(22) PCT Filed: Feb. 10, 2017

(86) PCT No.: PCT/EP2017/052969
§ 371 (c)(1),
(2) Date: Jul. 31, 2018

(87) PCT Pub. No.: WO2017/137540
PCT Pub. Date: Aug. 17, 2017

(65) Prior Publication Data

US 2019/0270097 A1 Sep. 5, 2019

(30) Foreign Application Priority Data

Feb. 12, 2016 (EP) ..... 16425009

(51) Int. Cl.
*B04C 5/04* (2006.01)
*B04C 3/06* (2006.01)
*D21B 1/36* (2006.01)

(52) U.S. Cl.
CPC ..... *B04C 5/04* (2013.01); *B04C 3/06* (2013.01); *D21B 1/36* (2013.01)

(58) Field of Classification Search
CPC ... B01D 17/0217; B01D 21/2411; B04C 5/04; B04C 5/085; B04C 5/14; B04C 3/05
(Continued)

(56) References Cited

U.S. PATENT DOCUMENTS 6,267,803 B1 * 7/2001 Escobar ..... B01D 45/16 55/337
2014/0110509 A1 4/2014 Rawls et al.

FOREIGN PATENT DOCUMENTS

WO 2010/001097 A1 1/2010

* cited by examiner

*Primary Examiner* — Claire A Norris
(74) *Attorney, Agent, or Firm* — Edwin A. Sisson; Jeffrey J. Banyas

(57) ABSTRACT

It is disclosed an apparatus for separating a least one solid from a solids/fluid mixture, said apparatus comprising a separation chamber and a cushion chamber. The separation chamber comprises a top end, a bottom end, at least one wall, and an inlet port for introducing the solids/fluid mixture, said inlet port having an inlet port vector. The cushion chamber comprises at least one boundary wall, and it is adapted to maintain a cushion of the solids/fluid mixture at an intersection of the inlet port vector and the cushion chamber when the separation chamber and the cushion chamber are connected by a communication port at the intersection of the inlet port vector and the at least one wall. The communication port has an area at least a size of an impact area of the solids/fluid mixture on the at least one wall. The communication port may be formed by the erosion of the at least one wall of the separation chamber caused by the solids/fluid mixture at the impact area.

It is also disclosed a process for separating a solids/fluid mixture, wherein the solids/fluid mixture is introduced through the inlet port of the separation chamber and contacted with a cushion of a previously introduced solids/fluid mixture, the solids/fluid mixture being allowed to interact with the cushion of the previously introduced solids/fluid mixture. The at least one solid is separated from the fluid by density difference in the separation chamber. Preferably, the
(Continued)

solids/fluid mixture is steam treated lignocellulosic biomass which is inserted in the disclosed apparatus at high velocity.

20 Claims, 9 Drawing Sheets

(58) Field of Classification Search
USPC ..... 210/512.1, 787, 788
See application file for complete search history.

APPARATUS AND PROCESS FOR SEPARATING A SOLIDS/FLUID MIXTURE

PRIORITIES AND CROSS REFERENCES

This application claims priority from International Application No. PCT/EP2017/052969 filed on 10 Feb. 2017 which claims priority from European Application No. 16425009.4 filed on 12 Feb. 2016, the teachings of each of which are incorporated by reference herein in their entirety.

BACKGROUND

In pulping technology, the wood feedstock is subjected to a cooking treatment process with chemical agents, known as white or green liquor, to remove lignin and hemicellulose, thereby producing a cellulosic pulp. Thanks to the high reactivity of the chemical agents, the cooking treatment is typically conducted in pressurized cooking reactors at moderate temperature and pressure, wherein pressurized steam is used mainly as a heating means. After the cooking treatment, the cellulosic pulp, which is a high consistency suspension of solid cellulosic fibers, is flashed in a blow tank to reduce the pressure to about atmospheric pressure.

Fardim, Pedro, "Chemical Pulping Part 1, Fiber Chemistry and Technology", Second Edition, Papermaking Science and Technology, 2011, pag. 288-289 ("Fardim"), reports an example of timing and process conditions in a conventional batch kraft cooking system. FIG. 92 illustrates temperature and pressure time profiles. The process temperature is raised to about 175° C. in about 2 hours, then cooking occurs for a cooking time of 45 minutes at a cooking pressure of about 8 bar. Heating is provided by steam at a pressure up to 12 bar, and it is stopped during the cooking phase. After the cooking step, the pulp is blown down in a blow tank. Chips are disintegrated to fibers during the blow, in the blow line, and on the entry to the blow tank through the shearing action caused by turbulent flow and flashing of steam. An example of a blow tank is provided in FIG. 93 in Fardim. The blow tank is equipped with a cyclone separator to allow fiber-free steam to flow to the flash steam condensing system. The blow tank is a large vessel, with standard volume ranging from 100 $m^3$ to 900 $m^3$, to take into account the steam expansion during the blow. The blow tank has a circular shape, with an outlet for pulp discharge at the bottom end and an outlet for flash gas at the top end. The pulp is fed through a blow inlet horizontally located in the upper part of the blow tank.

The working principle of a blow tank, also known as a blow cyclone or pressure cyclone, may be found in Lonnberg, Bruno, "Mechanical Pulping", Second Edition, Papermaking Science and Technology, 2009, pag. 200 ("Lonnberg"). FIG. 23 in Lonnberg shows the configuration of a large-diameter cyclone. The pressure cyclone consists of a cyclone with steam/pulp inlet and a steam outlet, a jacket scraper, a plug screw feeder and a counter-pressure device in the bottom. The surplus steam from the refiner blows the pulp to the top of the pressure cyclone, where it is fed in tangentially under pressure. The pulp and steam are separated by the combined effect of centrifugal and gravity forces. The steam goes upwards in the center of the cyclone and out to a heat recovery system. A scraper prevents pulp from getting stuck on the inside of the jacket. In the bottom of the cyclone a discharge screw feeds the pulp to a latency tank. The pulp plug and the counter-pressure device seal against the steam pressure in the cyclone.

WO 2010/001097 discloses a cyclone separator for separating particles from a mixture of gas and particles, said cyclone separator comprising: a separation chamber in which the particles are separated from the gas; an inlet configured to provide the mixture of particles and gas to the separation chamber; a reverse flow gas outlet positioned to receive a portion of the gas, from which particles have been separated, from the separation chamber, the direction of this portion of the gas having been reversed in the separation chamber; and a unidirectional flow gas outlet positioned to receive another portion of the gas, from which particles have been separated, from the separation chamber, the direction of this portion of the gas not having been reversed in the separation chamber.

Steam explosion is a well-known pre-treatment process for lignocellulosic feedstocks, in which the ligno-cellulosic feedstock is first subjected to a hydrothermal treatment in the presence of steam at high temperature and pressure, followed by rapid release of the pressure applied to the feedstock to produce an explosive disruption of the ligno-cellulosic structure. Thereby, the feedstock is inserted in a pressurized reactor, wherein the pressure is usually obtained by inserting steam in the reactor at a temperature which can be about 200° C. Steam reactor pressure can be as high as 20 bar, thereby far exceeding the pressure applied to the wood feedstock in chemical pulping process. A mixture of ligno-cellulosic feedstock and fluid comprising water in liquid or vapor form is removed from the pressurized reactor through a feedstock outlet and introduced in a blow cyclone at about atmospheric pressure through a blow line. Due to the change of the pressure applied to the feedstock, the water entrapped in the feedstock cells is subjected to a rapid expansion, causing the expansion of the feedstock cells until reaching in some cases the explosion of the cells themselves. Therefore, in a steam explosion process the pressure applied to the feedstock is released as quickly as possible, by suitably designing the configuration of the blow line.

Consequently, the solids/fluid mixture is accelerated through the blow line by the difference of pressure between the pressurized reactor and the blow cyclone, and at the entry in the blow cyclone it may attain a velocity which is close to the sound speed. The velocity of the solids/fluid mixture is far exceeding the velocity attained by the pulp at the entry of the blow cyclone in a pulp process.

The solids/fluid mixture is typically introduced in the blow cyclone tangentially or almost tangentially, which means that its velocity direction at the inlet of the blow cyclone forms a low angle with the impact point or area on the blow cyclone wall. Differently from the pulp process, in a steam explosion process the solids in the blow cyclone behave as bullets striking the blow cyclone wall.

When used in a steam explosion process, a blow cyclone designed for a pulp process is therefore subjected to abrasive erosion and failure due to perforation of the cyclone wall in a short operating time, which can be in the order of a few days. Besides the repair costs, frequent downtime cycles have dramatic consequences on the process performance and costs, especially in an industrial plant operated continuously.

There is therefore the need for a blow cyclone which can be used without failing and being damaged when solids/fluid mixture is introduced at a high velocity.

SUMMARY

This specification discloses an apparatus for separating a least one solid from a solids/fluid mixture, said apparatus comprising a separation chamber and a cushion chamber, wherein the separation chamber comprises a top end, a bottom end, at least one wall, and an inlet port for introducing the solids/fluid mixture into the separation chamber, said inlet port having an inlet port vector which is the direction at which the solids/fluid mixture enters the separation chamber, wherein the cushion chamber comprises at least one boundary wall, and said cushion chamber is adapted to maintain a cushion of the solids/fluid mixture at an intersection of the inlet port vector and the cushion chamber when the separation chamber and the cushion chamber are connected by a communication port at the intersection of the inlet port vector and the at least one wall of the separation chamber.

It is also disclosed that said communication port may have an area at least a size of an impact area of the solids/fluid mixture on the at least one wall of the separation chamber in the absence of the communication port.

It is further disclosed that at least a portion of the communication port may have been created by an erosion of the at least one wall caused by the solids/fluid mixture.

It is also disclosed that the communication port may have a rectangular shape.

It is further disclosed that the inlet port vector may have an incidence angle with the at least one wall which is in a range selected from the group consisting of from greater than 0° to less than 45°, and from greater than 0° to less than 30°.

It is also disclosed that the cushion chamber may be in the shape of a box comprised of planar boundary walls.

It is further disclosed that the cushion chamber may have at least one curved boundary wall.

It is also disclosed that the solids/fluid mixture may be steam treated lignocellulosic biomass.

It is further disclosed that the solids/fluid mixture may comprise water in liquid or vapor phase.

The specification also discloses a process for separating at least one solid from a solids/fluid mixture comprising: introducing the solids/fluid mixture at a mean linear velocity having a mean linear velocity vector through an inlet port of a separation chamber comprised of at least one wall with the separation chamber connected to a cushion chamber through a communication port located at the intersection of the mean linear velocity vector and the at least one wall of the separation chamber, the cushion chamber containing a cushion of a previously introduced solids/fluid mixture, wherein the inlet port vector is the direction at which the solids/fluid mixture enters the separation chamber, contacting the solids/fluid mixture with the cushion of the previously introduced solids/fluid mixture; separating at least a portion of the fluid from the solids/fluid mixture in the separation chamber by density difference.

In the disclosed process, the communication port may have an area at least a size of an impact area of the solids/fluid mixture on the at least one wall of the separation chamber in the absence of the communication port In the disclosed process, the communication port may further have a rectangular shape.

In the disclosed process, the mean linear velocity vector may further have an incidence angle with the separation chamber which is in a range selected from the group consisting of from greater than 0° to less than 45°, and from greater than 0° to less than 30°.

In the disclosed process, the cushion chamber may further be in the shape of a box comprised of planar boundary walls.

In the disclosed process, the cushion chamber may further have at least one curved boundary wall.

It is also disclosed that the mean linear velocity may be greater than 100 m/s.

It is further disclosed that the solids/fluid mixture may be introduced in a continuous mode.

It is also disclosed that the solids/fluid mixture may be introduced in a pulsed mode at a frequency greater than 1 Hz.

It is further disclosed that the solids/fluid mixture may be steam treated lignocellulosic biomass It is also disclosed that the solids/fluid mixture may comprise water in liquid or vapor phase.

It is further disclosed that the inlet port may be upstream connected to a pressurized reactor, and the pressure in the pressurized reactor may be at least 8 bar greater than the pressure in the separation chamber.

It is also disclosed that the pressure in the separation chamber may be in a range from 0.5 bar to 4 bar.

It is further disclosed that the disclosed process may further comprise steam exploding the steam treated lignocellulosic biomass.

It is further disclosed that the inlet port may connected to a pressurized reactor upstream of the separation chamber, and the pressure in the pressurized reactor is at least 8 bar greater than the pressure in the separation chamber

DETAILED DESCRIPTION

The disclosed apparatus and process are for separating solids and fluids of a solids/fluid mixture. While the apparatus and process have been conceived for separating a steam exploded solid ligno-cellulosic feedstock and steam from the solids/fluid mixture, the separation occurring downstream of a pressurized reactor, it has been found that the apparatus and process may be applied also to the separation of more general solids/fluid mixtures, including for instance pressurized mixtures of gas (i.e. compressible fluids) and solid particles in mining or construction industry.

A detailed description of a ligno-cellulosic feedstock may be found in WO02015028156A1, pg. 11-14, which is herein incorporated by reference in its entirety. A preferred ligno-cellulosic feedstock is selected from the group of agricultural residues, in particular straws such as wheat straw, rice straw, or bagasse, such as sugar cane bagasse. The hardwoods and softwoods also benefit from this process.

Figure 1:
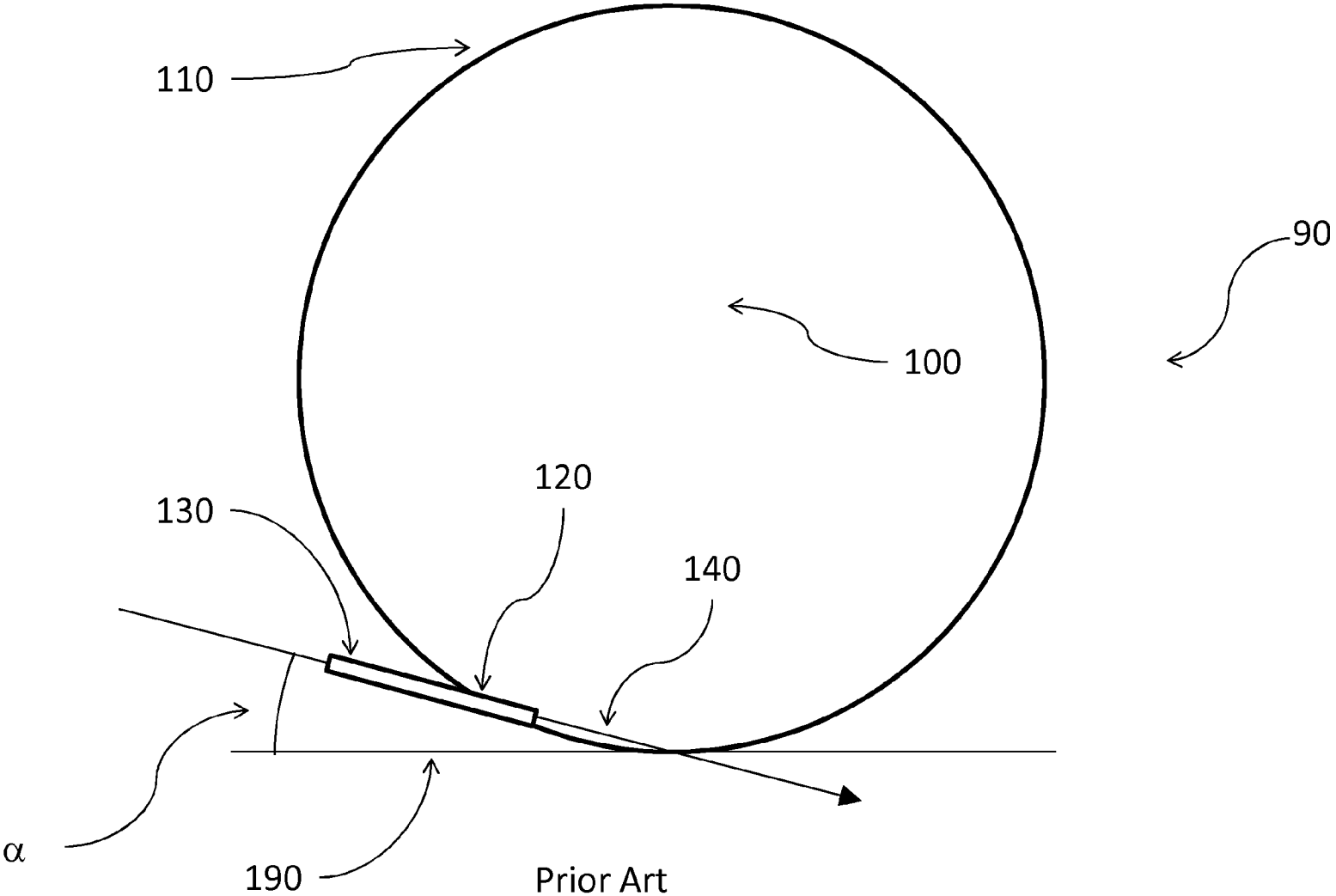
Prior Art FIGURE 1
FIG. 1 is a cross-sectional top view of a typical separation chamber found in the prior art.

The disclosed apparatus and process arise from a long series of failures in using a pulp blow cyclone separator designed for pulp processing, in particular, when the pulp blow cyclone is used for separating a solid steam exploded feedstock and steam from a solids/fluid mixture inserted at high velocity in the pulp blow cyclone separator. In the present specification, the terms "blow tank", "blow tank separator", "pulp blow tank", "pulp blow tank separator", and "blow cyclone" are synonymous terms, as recurring in the standard terminology in the pulp field. FIG. 1 depicts a schematic representation of a pulp blow cyclone separator of the prior art which failed to work with a solids/fluid mixture inserted at high velocity. FIG. 1 schematically represents a transversal section of a pulp blow cyclone separator (90) comprising a separation chamber (100) comprising a cylindrical wall (110), said separation chamber wall having an inlet port for the solids/fluid mixture (120). Associated with or included in the inlet port is a cylindrical blow pipe (130) for introducing the solids/fluid mixture in a preferential direction. In the failed experiments and working examples, the diameter of the blow pipe was about 5.1 cm (2 inches). The direction at which the solids/fluid mixture enters the separation chamber is called the inlet port vector (140). Thereby the inlet port defines an inlet port vector, which in the exemplary case considered in FIG. 1, corresponds to the axis of the cylindrical blow pipe. The blow pipe may be inserted in the separation chamber through the inlet port, and it may extend in the separation chamber until being in proximity of an internal wall of the separation chamber. The incidence angle $\alpha$ of the solids/fluid mixture on the wall of the separation chamber is defined as the angle between the inlet port vector (140) corresponding to the center of the cylindrical blow pipe (130) and a plane (190) tangent to the internal wall of the separation chamber at the point of intersection of the inlet port vector and the internal wall of the separation chamber.

The tangent plane is normal to the section of the separation chamber depicted in FIG. 1 and it is thereby represented by a straight line. In a typical configuration, called tangential, as depicted in FIG. 1, the incidence angle ($\alpha$) as defined in the present specification is about 15°.

Figure 2:
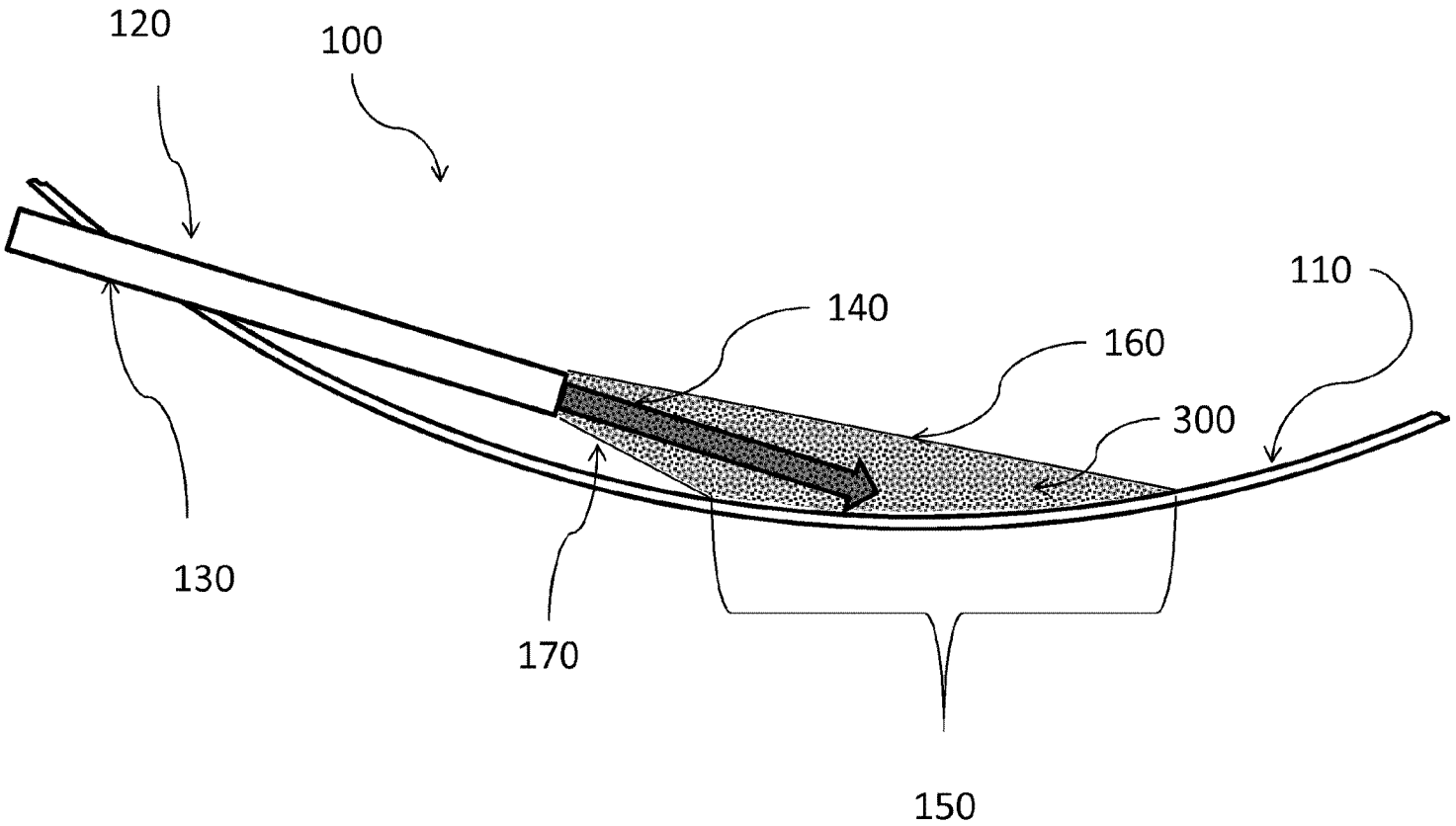
Prior Art FIGURE 2
FIG. 2 is a close-up of a cross-sectional top view of a typical separation chamber found in the prior art showing the incoming mixture expanding into a plume and striking the opposing wall of the separation chamber.

FIG. 2 depicts an enlargement of the pulp blow cyclone separator of FIG. 1 to show the working principle of the separation process of the prior art. The solids/fluid mixture enters the separation chamber (100) through the cylindrical blow pipe (130) in the direction of the inlet port vector (140) and travels through the separation chamber, eventually slightly expanding from the inlet port vector to form a plume (300) bounded by the expanding lines 160 and 170, until reaching the internal wall of the separation chamber at an impact area (150) comprising the point of intersection of the inlet port vector (140) and the internal wall. The impact area (150) is the portion of the internal wall of the separation chamber which is hit by the solids/fluid mixture after it exits the cylindrical blow pipe.

At a low incidence angle, the impact area (150) assumes an elongated shape, even in the absence of plume expansion.

Figure 3:
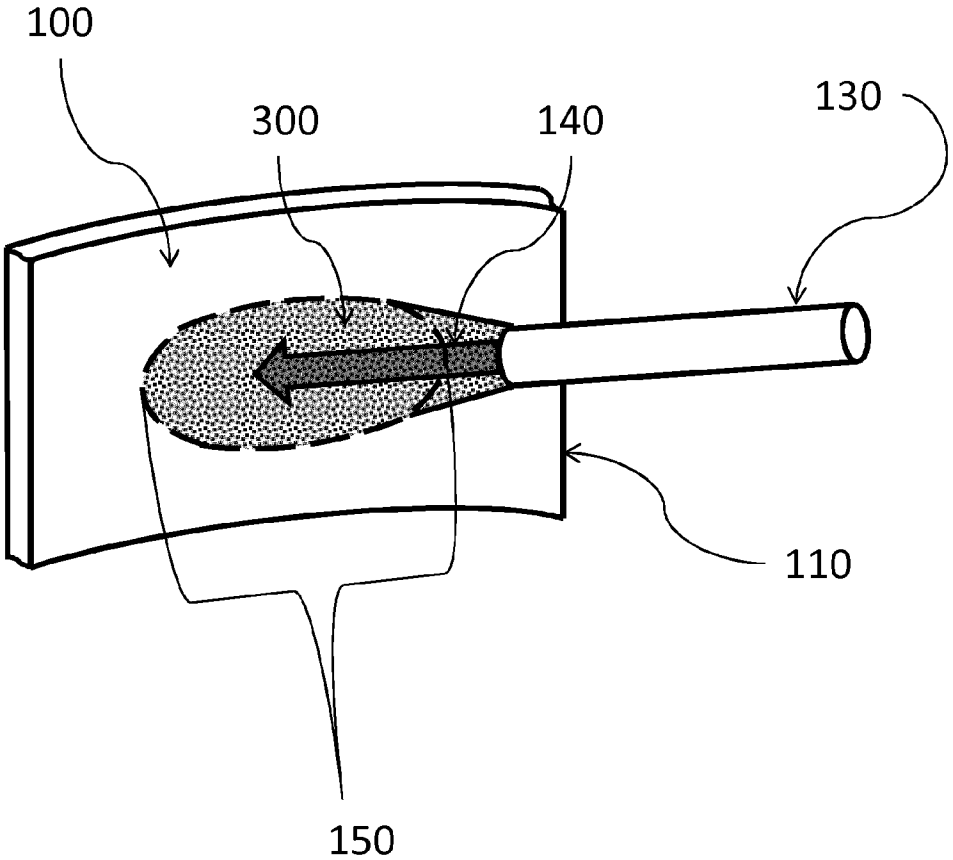
Prior Art FIGURE 3
FIG. 3 depicts the impact area formed by the plume in a typical separation chamber found in the prior art from the perspective of looking normal to the inside wall of the separation chamber.

FIG. 3 depicts details of a vertical internal cross-section of the separation chamber (100) in operating conditions, showing the elongated impact area (150) formed by the solids/fluid mixture as it, exits the cylindrical blow pipe (130) in the direction of the inlet port vector (140), on the internal side of wall (110) of the separation chamber (100). The impact area (150) is represented by a dotted line. By hitting the internal wall of the separation chamber, the solids/fluid mixture is bounced off the internal wall, assuming a spiral motion while the solids and fluid is separated by gravity density, with the solids moving toward the bottom end of the separation chamber and the fluid (i.e. steam) recovered from the top end of the separation chamber. Were the solids lighter than the fluid the solids would be recovered from the top end of the separation chamber and the fluid from the bottom end of the separation chamber. At typical operating conditions of a pulping process, no catastrophic abrasive erosion of the separation chamber occurs at the impact area position, and the apparatus properly operates over prolonged continuous runs.

Figure 4:
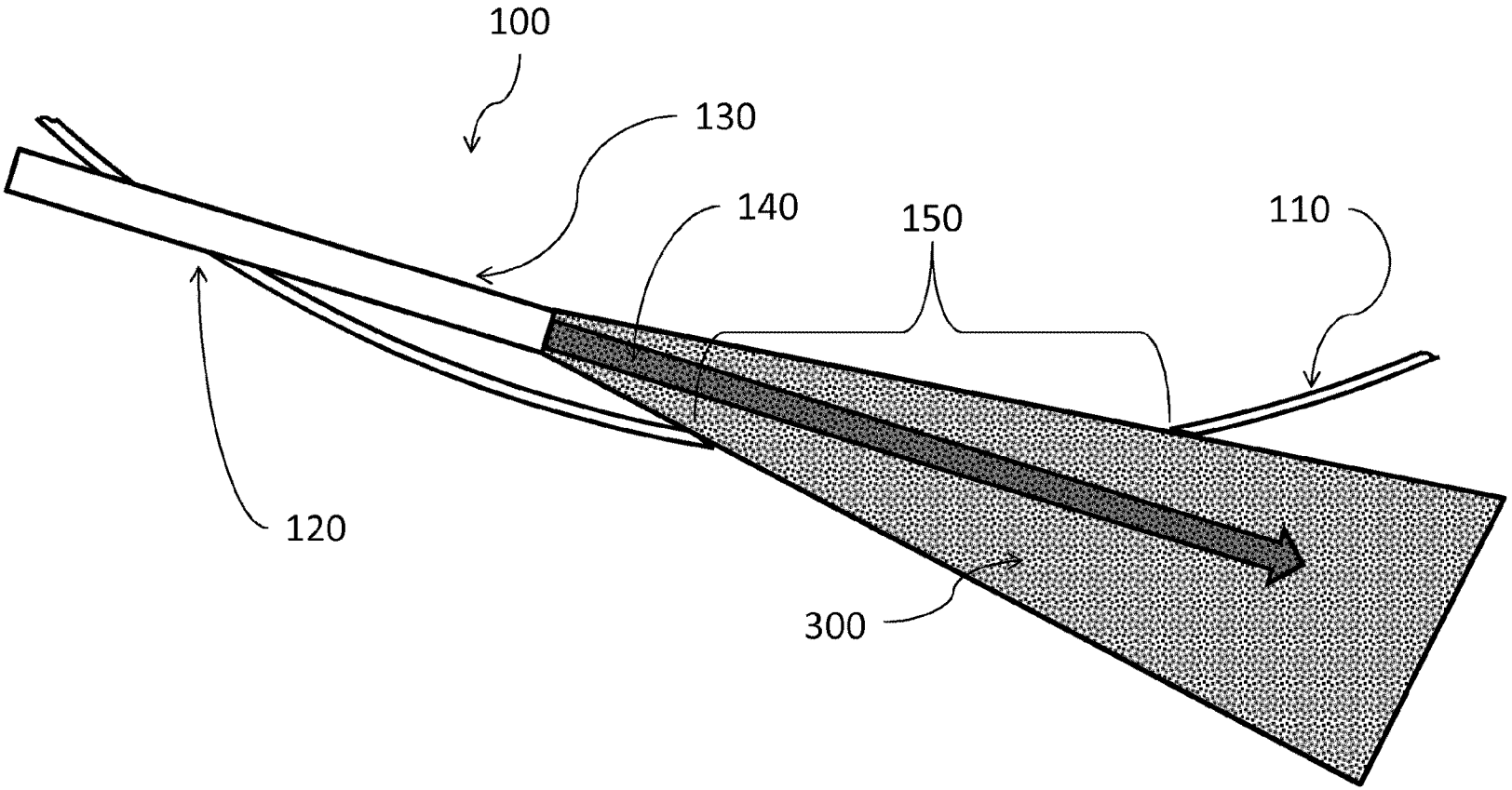
Prior Art FIGURE 4
FIG. 4 is a close-up of a cross sectional top view of the prior art separation chamber after the wall has been abrasively eroded away at the impact area.

The Inventors observed that inserting or injecting a solids/fluid mixture at high velocity in the separation chamber of a pulp blow cyclone separator, wherein the solids/fluid mixture is accelerated by a difference of pressure which is typically greater than about 10 bar as usually occurs in a steam explosion process results in a rapid abrasive erosion at the impact area position of the internal wall of the separation chamber, causing the formation of an elongated hole on the wall of the separation chamber with consequent leakage of material to the external environment. The horizontal size of the hole was about 20 cm, and the vertical size was about 12 cm. The pulp blow cyclone separator worked properly for a total time of a few days, as pictorially depicted in FIG. 2 and FIG. 3, while FIG. 4 depicts the failure condition, wherein the leakage of material is indicated by the dotted area expanding from the blow line (130) through a hole located at the impact area (150). The Inventors first tried to repair the pulp blow cyclone separator by welding a thick sacrificial plate of hard metal to seal the hole. That solution failed as the thick plate was also eroded after a total operating time of a few days. The total operating time until a hole was formed clearly depends on the velocity of the solids/fluid mixture and the hardness and thickness of the sacrificial plate. Nevertheless all the tests ran by the Inventors realized hole formation at the position of the impact area.

The Inventors then added a cushion chamber to the external wall of the separation chamber, the cushion chamber encompassing the small hole in the wall of the separation chamber. With the cushion chamber attached to the separation chamber, the pulp blow cyclone separator was operated continuously for a total operating time of at least one month without forming a hole in the wall of the cushion chamber that would expose the separation chamber to atmospheric pressure and allowing leakage of material to the external environment. When the separation chamber was opened for investigation it was discovered that the abrasive erosion had continued until the original hole in the wall reached approximately the size of the impact area at the internal wall and slightly larger on the external wall indicative of the plume expansion. This difference is quite small given that the wall is only 10 mm thick. At this point, no further abrasive erosion was observed. In the working example, the cushion chamber encompasses an encompassed area of the separation chamber wall which was greater than the size of the hole in the wall of the separation chamber. The encompassed area extended for a length of some centimeters in each direction around the hole in the wall.

Figure 5:
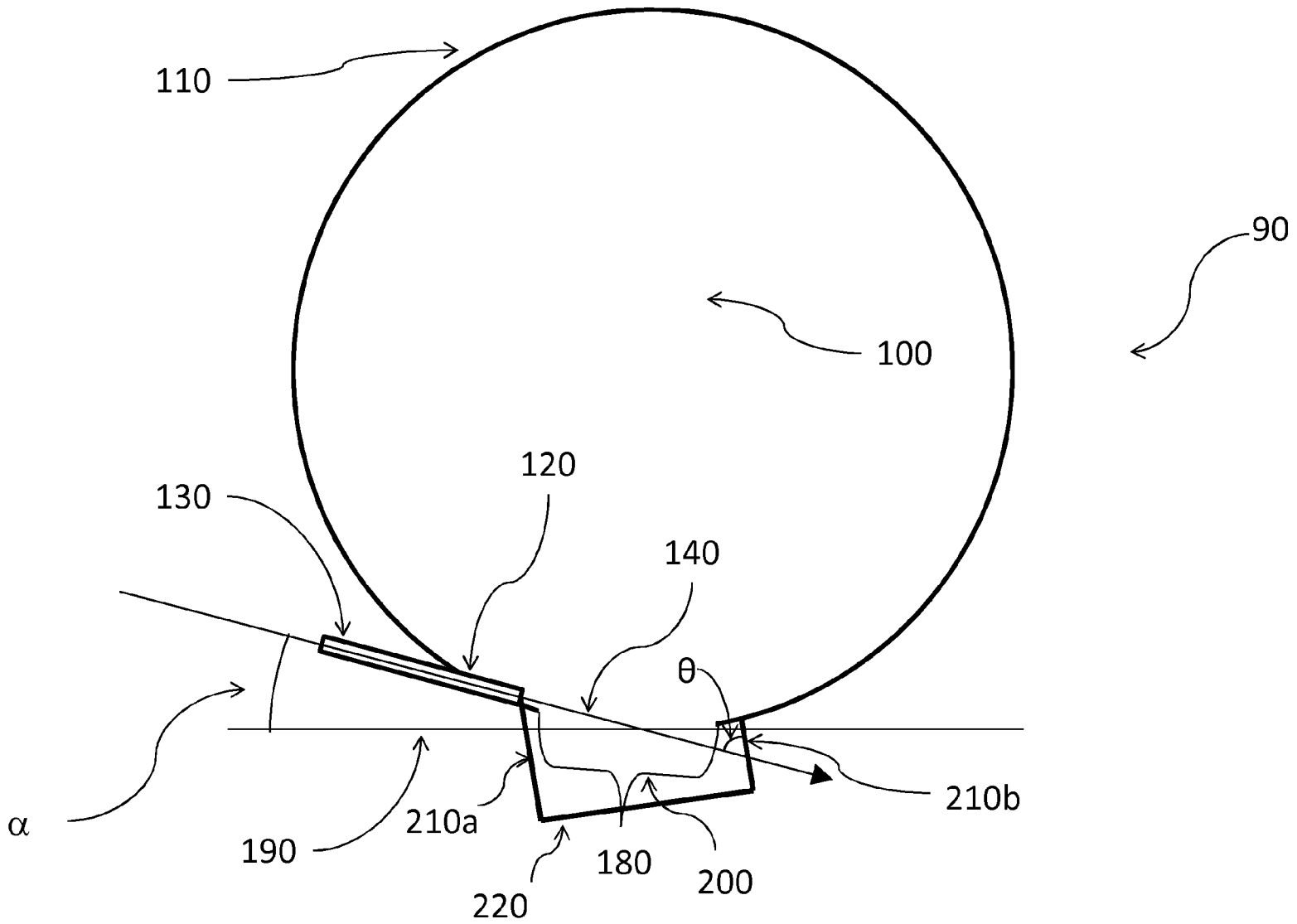
FIG. 5 is a cross-sectional top view of a separation chamber containing an embodiment of the invention.
Figure 6:
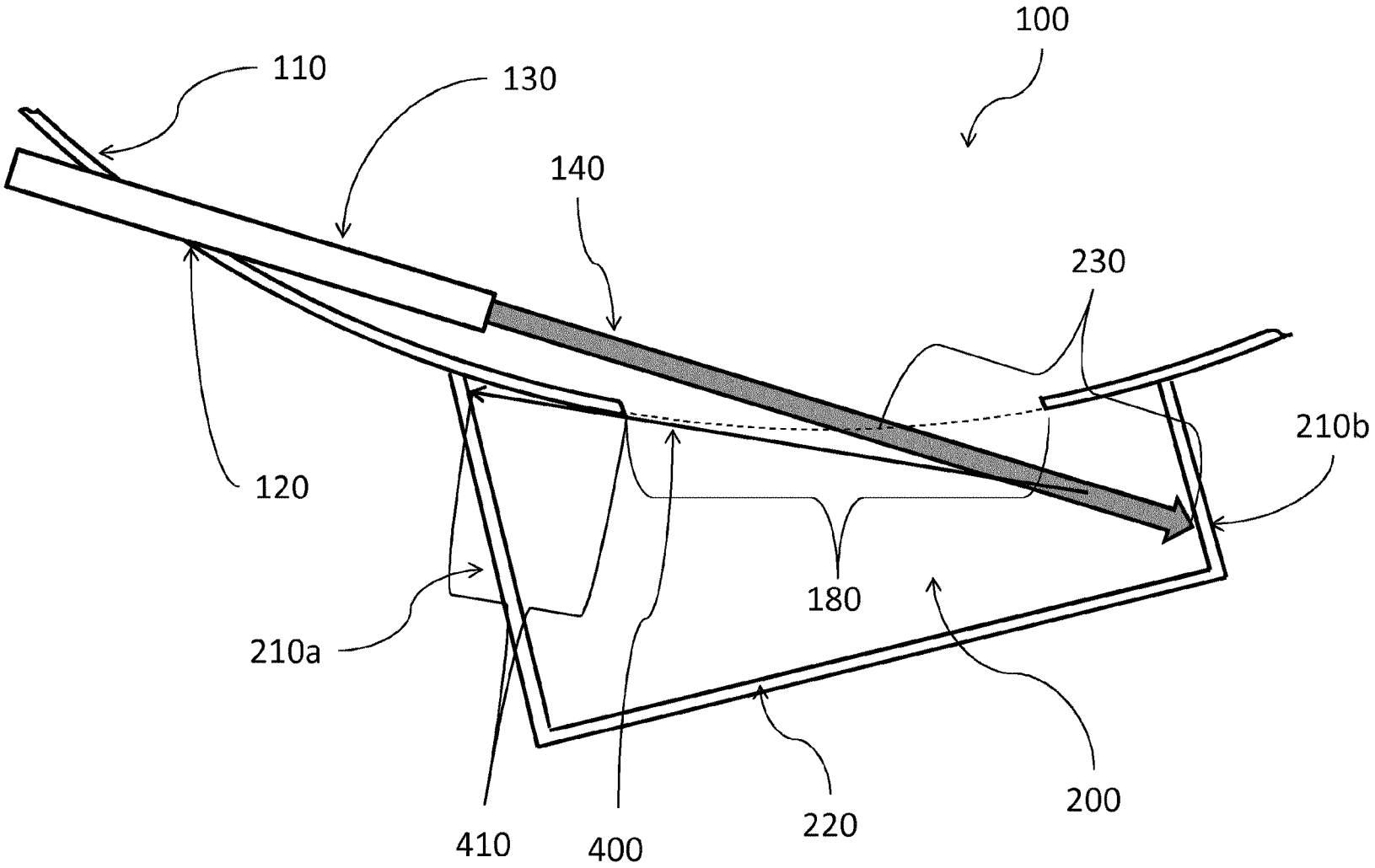
FIG. 6 is a close-up of a cross sectional top view of an embodiment of the invention.

FIGS. 5 and 6 depict details of the disclosed apparatus, with FIG. 6 showing an exemplary design of the cushion chamber (200) which solved the erosion problem. The exemplary cushion chamber (200) is comprised of five boundary walls, three of which (210*a*, 210*b*, 220) are shown in the figures, the boundary walls forming a box with an open side located at a position encompassing the hole in the separation chamber wall. As shown in the figures, the encompassed area of the cushion chamber extends in each direction for a length of some centimeters around the hole. Thereby, the eroded hole in the wall of the separation chamber having at least the size of the impact area acts as a communication port (180) between the separation chamber (100) and the cushion chamber (200), the communication port being placed at the intersection of the inlet port vector (140) and the cylindrical wall (110) of the separation chamber. In the exemplary cushion chamber, the boundary walls had a rectangular shape, the boundary wall (220) opposed to the communication port was 62 cm by 18 cm, the first lateral boundary wall (210*a*) was 47 cm×18 cm, the second lateral boundary wall (210*b*) was 23 cm×18 cm, with the lateral boundary walls realizing the connection with the cylindrical separation chamber.

Figure 7:
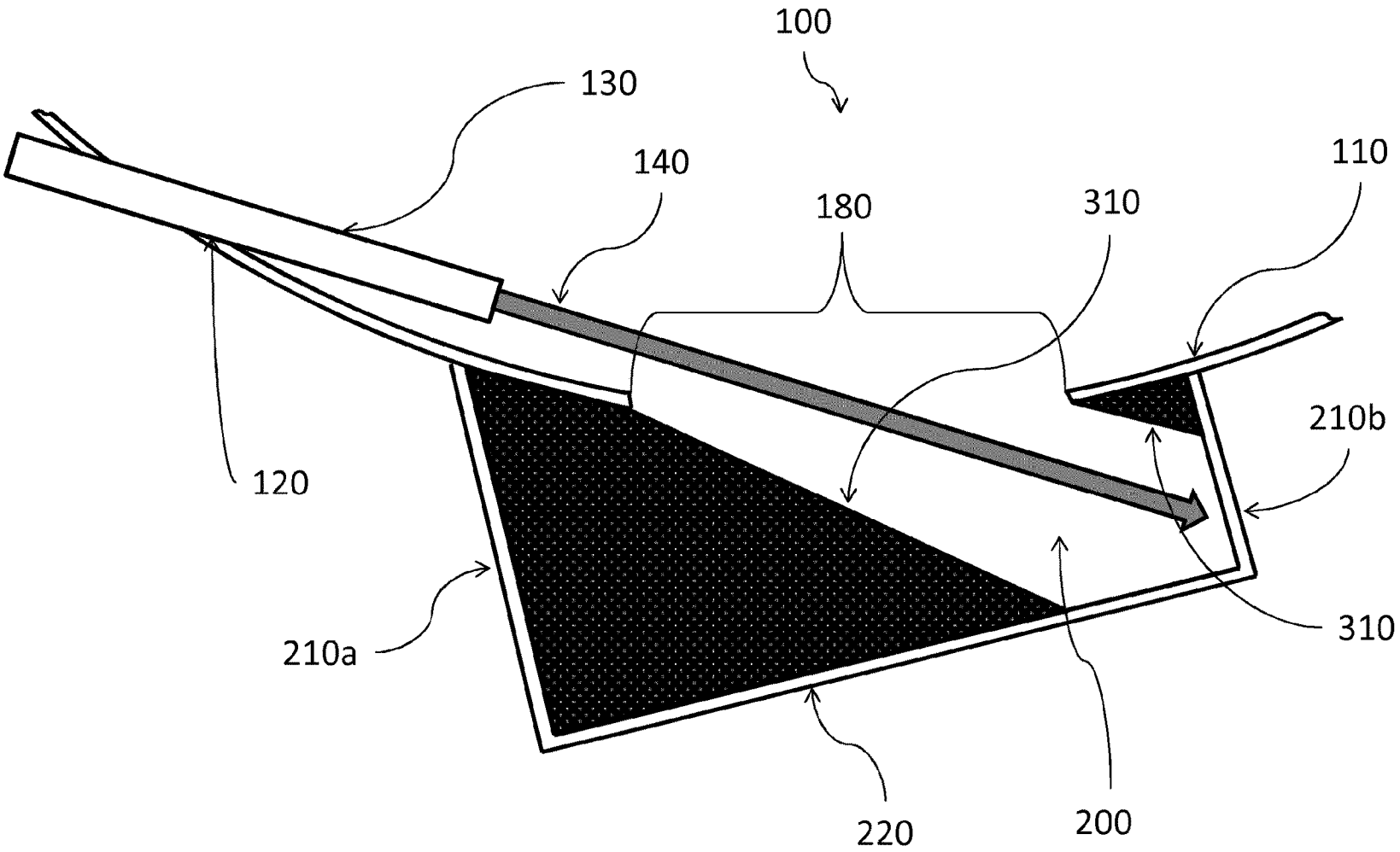
FIG. 7 is a close-up of a cross sectional top view of an embodiment of the invention wherein the separation chamber is in communication with a cushion chamber.

FIG. 7 shows a section of the separation apparatus at the end of each test run. The Inventors observed that a compact deposit of solid steam exploded biomass (310) was present at the lateral zones of the cushion chamber lying outside the impact area while a central volume of the cushion chamber, encompassing the inlet port vector and oriented approximately along the direction of the inlet port vector, was completely void of material, the void central volume extending until the boundary walls. Thereby, a portion of the boundary walls (220 and 210*b*) encompassing the inlet port vector, directly facing the incoming plume, was found void of any accumulated material, and without any evidence of abrasive erosion.

Figure 8:
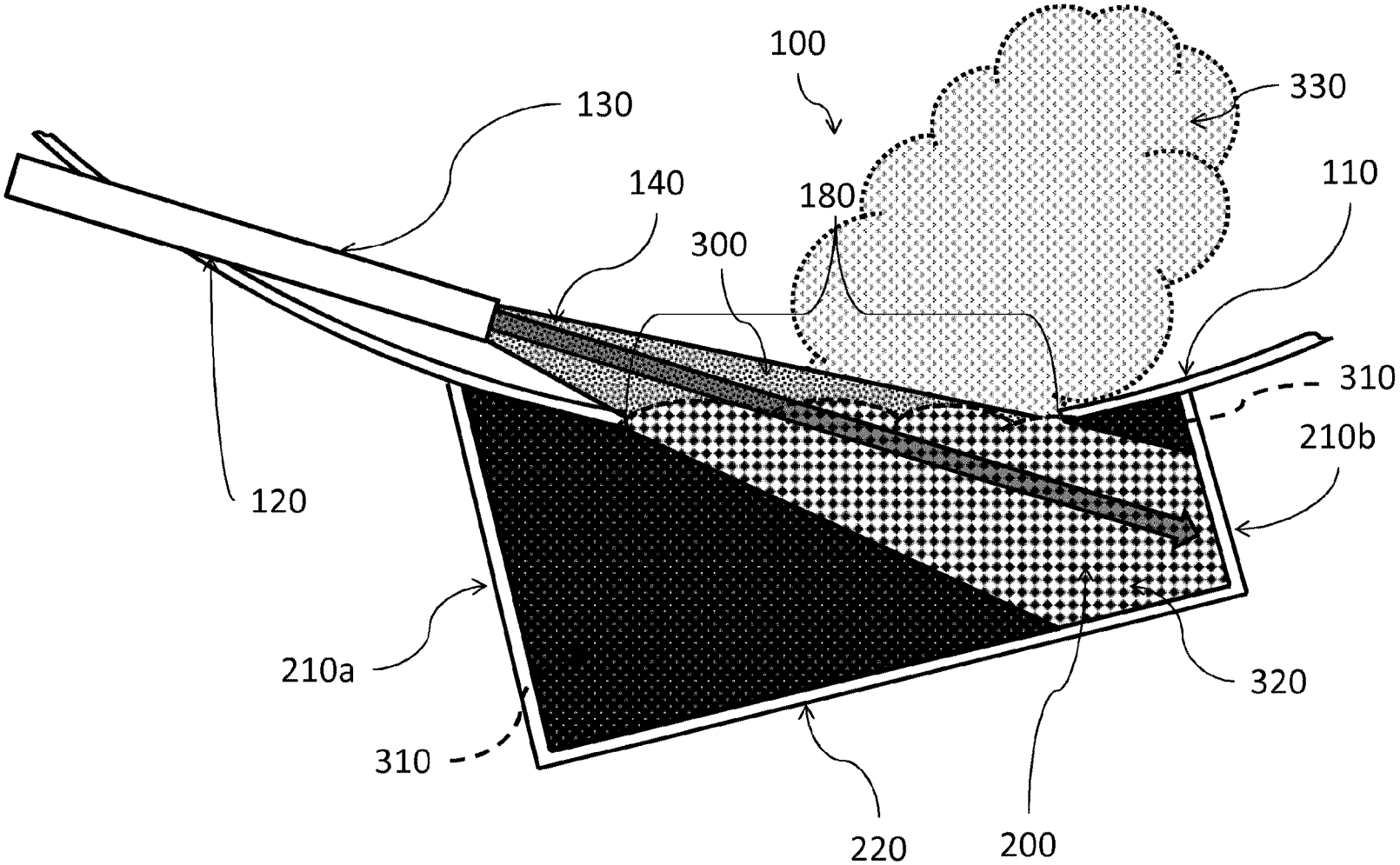
FIG. 8 is a close-up of a cross sectional top view of an embodiment of the invention during operation wherein the separation chamber is in communication with a cushion chamber.

Without being limited by any theory or interpretation, the Inventors believe that the solids/fluid mixture, entering the cushion chamber through the communication port formed by the abrasive erosion of the wall of the separation chamber, contacts a previously introduced solids/fluid mixture in the cushion chamber, thereby causing at least a portion of the solids to lose a portion of their kinetic energy in this interaction, with at least a portion of the solids (330) emerging then into the separation chamber without damaging the boundary walls of the cushion chamber. The Inventors believe that a sort of cushion of previously introduced solids/fluid mixture (320) is formed in the cushion chamber (200) as depicted in FIG. 8. The fluid dynamical description of the contact and interaction of the previously introduced solids/fluid mixture with the plume of incoming solids/fluid mixture (300) may be very difficult and in any case approximate. The Inventors believe that the cushion (320) is at least in part a dynamical cushion caused by the swirling motion of the previously introduced solids/fluid mixture in the cushion chamber, wherein the expansion of the fluid of the solids/fluid mixture may also play an important role. On the other hand, the cushion may be at least in part a static cushion, as the solids of the solids/fluid mixture are continuously accumulated on boundary walls of the cushion chamber and continuously removed by the incoming solids/fluid mixture, whereas a permanent accumulation of solids occurs in the regions of the cushion chamber not directly exposed, or less exposed, to the incoming solids/fluid mixture.

Independent of the fluid dynamic mechanism involved, the cushion of the solids/fluid mixture (320) is located at least in the cushion chamber (200) at the intersection of the inlet port vector (140) and the cushion chamber (200), and its presence in the cushion chamber during operation can be easily verified by inspecting the cushion chamber after an operating run. The presence of a void volume in the cushion chamber, the void volume intercepting the inlet port vector, indicates a cushion of solids/fluid mixture in operating conditions. Depending on operating conditions and the geometrical configuration of the cushion chamber, the void volume may extend until reaching one or more boundary walls of the cushion chamber, or alternatively a layer of deposited solids may be present on the whole of the boundary walls. Once that the cushion effect was discovered, the Inventors also found that the cushion of the previously introduced solids/fluid mixture may be maintained at the intersection of the inlet port vector and the cushion chamber even when the shape and size of the cushion chamber is varied over a large extent from the box shape of the exemplary design. The shape of the cushion chamber may be also quite irregular, as solids will eventual accumulate in dead zones and a cushion region will self-form in a volume of the cushion chamber intercepting the inlet port vector, the remnant portion of the cushion chamber being filled with accumulated solids of the solids/fluid mixture. Thereby, in one embodiment, the cushion chamber may comprise at least one curved boundary wall, such as a portion of a sphere, or a portion of a cylinder. It is said that the cushion chamber is adapted or designed to maintain a cushion of the solids/fluid mixture at an intersection of the inlet port vector and the cushion chamber when the separation chamber and the cushion chamber are connected by a communication port at the intersection of the inlet port vector and the at least one wall, said communication port having an area at least a size of an impact area of the solids/fluid mixture on the at least one wall in the absence of the communication port.

The length from the intersection of the inlet port vector to the cushion chamber wall (FIG. 6, 230) is the main parameter in adapting or designing the cushion chamber to maintain a cushion of the solids/fluid mixture at an intersection of the inlet port vector and the cushion chamber when the separation chamber and the cushion chamber are connected by a communication port at the intersection of the inlet port vector and the at least one wall, said communication port having an area at least a size of an impact area of the solids/fluid mixture on the at least one wall in the absence of the communication port. This length, which is shown in FIG. 6 as (230), is the distance from the intersection point of the inlet port vector (140) with the cylindrical wall of the separation chamber (110), and the intersection point of the inlet port vector (140) with the cushion chamber (200). The Inventors have found that there is not an upper limit to this length, as the solids will eventual accumulate on the boundary wall of the cushion chamber facing the inlet port vector forming a static cushion of solids. The upper limit of the length of the intersection of the inlet port vector with the cushion chamber will be determined by criteria of practical deployment of the cushion chamber, and it is preferably less than 2 m, more preferably less than 1 m, and most preferably less than 50 cm. The Inventors have also found that, by reducing the length of the intersection of the inlet port vector with the cushion chamber, the depth of the cushion of previously introduced solids/fluid mixture (320) intercepting the incoming plume of solids/fluid mixture (300) in the cushion chamber will not be sufficient to ensure an efficient cushion effect, and a certain erosion of the boundary wall will start to occur. Stated in other word, there exists a lower limit to the length of the intersection of the inlet port vector with the cushion chamber (230), the limit being dependent on the properties of the solids/fluid mixture, its velocity and the acceptable erosion rate, as well as the material used to realize the cushion chamber. In some cases, the length from the intersection of the inlet port vector to the cushion chamber wall may be greater than 2.5 cm, preferably greater than 5 cm, and most preferably greater than 10 cm.

In a preferred embodiment, the cushion chamber is adapted in such a way that the inlet port vector intersects a boundary wall of the cushion chamber at an impact angle θ as shown in FIG. 5 which is in a range from 45° to 90°, and preferably from 50° to 70°. Namely, at high impact angles eventual erosion of the boundary wall is prevented or significantly reduced. In another embodiment, the impact angle on the boundary wall of the cushion chamber is greater than the incidence angle on the wall of the separation chamber.

It would be appreciated that on the basis of the disclosed information on the cushion effect discovered by the inventors, a person skilled in the art may easily adapt or define a suitable set of shapes and sizes of the cushion chamber, the cushion chamber being adapted to maintain a cushion of the solids/fluid mixture at the intersection of the inlet port vector and the cushion chamber, just by routinely testing different cushion chambers, or by using a test chamber with variable shape and size. For instance, a box shaped cushion chamber, such as the exemplary design of FIG. 5, may be provided of an internal wall opposed to the communication port which can be fixed at a variable distance from the communication port, thereby defining a set of cushion chambers having different lengths from intersection of the inlet port vector to the cushion chamber wall. Each cushion chamber may be tested in operating conditions for a testing time sufficiently long to highlight erosion by visually inspecting the internal walls of the cushion chamber.

The cushion chamber is connected to the outer wall of the separation chamber in a manner which isolates the atmospheres of the cushion and separation chambers from the external environment. In other words the connection between the separation chamber and cushion chamber is such that the connection is "air tight" or incapable of allowing a gas under a specified desired pressure to leak through the connection. This specified pressure will depend upon the performance parameters, the connection should be such that the gas will not pass under a pressure differential of least 0.5 bar between the separation chamber and the external environment surrounding the separation chamber. The ways to create this type of connection are well known in the art and can be achieved for example by welding some of the boundary walls of the cushion chamber to the external wall of the separation chamber or bolting the boundary wall of the cushion to the external wall of the separation chamber, preferably using a sealing gasket or gasket material between the boundary walls of the cushion chamber and the separation chamber.

Thereby, according to another aspect of the invention, a method to repair an apparatus for separating at least a portion of the fluid from a solids/fluid mixture is disclosed. This apparatus is initially comprised of a separation chamber which comprises an inlet port for introducing the solids/fluid mixture in a direction defined by an inlet port vector of the inlet port, wherein a leakage hole has been formed in a wall of the separation chamber. An example of such an apparatus is a pulp blow cyclone separator. Preferably, the solids/fluid mixture is introduced at high velocity, thereby causing the abrasive erosion of the separation chamber at the impact area of the solids/fluid mixture on the wall of the separation chamber. The method comprises the step of connecting a cushion chamber to the separation chamber with the cushion chamber encompassing the leakage hole, the cushion chamber being adapted to maintain a cushion of the solids/fluid mixture at the intersection of the inlet port vector and the cushion chamber. Preferably the cushion chamber encompasses the impact area of the solids/fluid mixture on the wall of the separation chamber, so as to encompass the maximum size of the leakage hole which is created by prolonged abrasive erosion at the impact area position.

According to another embodiment of the invention, it is provided a method to adapt or modify an apparatus for separating at least a portion of the fluid from a solids/fluid mixture, the apparatus essentially comprised of a separation chamber which comprises an inlet port for introducing the solids/fluid mixture in a direction defined by an inlet port vector of the inlet port. An example of such an apparatus is a pulp blow cyclone separator, which is modified to work with a solids/fluid mixture introduced in the separation chamber at high velocity before a leakage hole is created in a wall of the separation chamber at an impact area of the solids/fluid mixture on the wall of the separation chamber. The method comprises the step of adding a cushion chamber to the separation chamber with the cushion chamber encompassing an area on the separation chamber having at least the size of the impact area of the solids/fluid mixture on the wall of the separation chamber, so as to encompass the maximum hole which is created by prolonged abrasive erosion at the impact area position. The cushion chamber is adapted to maintain a cushion of the solids/fluid mixture at the intersection of the inlet port vector and the cushion chamber.

Another embodiment of the invention is an apparatus for separating at least a portion of the fluid from a solids/fluid mixture comprising a separation chamber and a cushion chamber. The separation chamber comprises at least one wall, a bottom end and a top end. The at least one wall has preferably a geometrical shape of a cylinder, indicating hereby that the real shape may locally diverge from a cylinder, for instance by introducing a modification which is small in comparison with the size of the cylinder. It is noted that the at least one wall may alternatively have other geometrical shapes, such as an elliptic cylinder, cone, trunked cone, and sphere, or other more complicated geometrical shapes preferably having a rotational axis of symmetry. As a further alternative, the separation chamber may have a geometrical shape having a central symmetry axis. For sake of clarity, a parallelepiped, a cube, a pyramid, a trunked pyramid are exemplary geometrical shapes having a central symmetry axis. The size of the separation chamber may be very large, varying over a broad range of dimensions, depending on the amount per hour of solids/fluid mixture introduced. As an example, the separation chamber may be sized according to Fardim, Pedro, "Chemical Pulping Part 1, Fiber Chemistry and Technology", Second Edition, Papermaking Science and Technology, 2011, pag. 289, showing a blow cyclone having a cylindrical wall with a volume from 100 $m^3$ to 900 $m^3$. The separation chamber and the cushion chamber may be made of a metallic material capable of supporting a difference of pressure of at least 0.5 bar with the external environment, preferably steel, more preferably stainless steel, and most preferably a corrosion resistant stainless steel such as that known in the art. The internal wall of the separation chamber may be coated with a hardened material layer such as ceramic. The separation chamber may further comprise a fluids outlet port for removing the fluids, which, when the solids are more dense than the fluids, is preferably located at or close to the top end of the separation chamber, and a solids outlet port for removing the solids, which is preferably located at or close to the bottom end of the separation chamber when the solids are more dense than the fluids. The fluids outlet port for removing the fluids, is preferably located at or close to the bottom end of the separation chamber, and the solids outlet port for removing the solids is preferably located at or close to the top end of the separation chamber when the solids are less dense than the fluids. Additional mechanical means for facilitating the removal of the solids, such as a rotating scraper, may be included in the separation chamber.

The separation chamber further comprises an inlet port of the solids/fluid mixture, said inlet port having or defining an inlet port vector which is the direction at which the solids/fluid mixture is introduced in the separation chamber. The inlet port may be seen as an opening on the separation chamber, preferably having a circular shape, and the inlet port vector may have a direction different from the axis of the inlet port. Namely, an inlet pipe, or conduit, for introducing the solids/fluid mixture in the separation chamber may be associated with or included in the inlet port, and the inlet port vector corresponds to the axis of the pipe at the end of the inlet pipe, which is the disengagement point of the solids/fluid mixture. Eventually, the inlet pipe may be inserted in the separation chamber through the inlet port, and it may extend in the separation chamber until being in proximity of an internal wall of the separation chamber. The inlet port vector will intersect the at least one wall of the separation chamber forming a range of incidence angles ($\alpha$), as it varies over the inlet port. The incidence angle is preferably a low incidence angle, from greater than 0° to less than 45°, more preferably from greater than 0° to less than 30°, and most preferably in the range of 5° to 30°. In the case that a center of the inlet port may be identified, the inlet port vector is considered applied to the center of the inlet port. In the exemplary embodiment of the inlet pipe, the inlet port vector is considered applied to the axis of the inlet pipe at the disengagement point. Alternatively, in the case that the inlet port has an irregular shape not having a center, the incidence angle $\alpha$ of the solids/fluid mixture on the wall of the separation chamber is defined as the arithmetic average between the minimum and maximum angle of incidence of the solids/fluid mixture on the wall of the separation chamber.

The solids/fluid mixture, is introduced into the separation chamber through the inlet port at a mean linear velocity having a mean linear velocity vector which is along the direction of the inlet port vector, then travels through the separation chamber, eventually slightly expanding around the inlet port vector to form a plume, until reaching an internal wall of the separation chamber at an impact area (150) comprising the point of intersection of the inlet port vector and the internal wall. The impact area is therefore the portion of the at least one wall of the separation chamber directly hit by the solids/fluid mixture. At a low incidence angle, the impact area assumes an elongated shape, even in the absence of plume expansion, due to trigonometrical projection. The wall of the separation chamber will be progressively abrasively eroded by the solids/fluid mixture hitting the wall at the position of the impact area. Therefore, one method to verify the presence and position of the impact area is to operate the separation chamber for a time sufficiently long to erode the at least one wall of the separation chamber, to form an opening which is not increased by further erosion. An alternative method, which is not destructive, is to deposit a thin coating layer on the internal surface of the at least one wall of the separation chamber, for instance by using a paint, and to operate the separation chamber for a sufficient time to remove the coating layer. The impact area will clearly correspond to the portion of the internal surface, wherein the coating layer has been removed.

The separation chamber and the cushion chamber are joined at a position of the separation chamber so that the portion of the separation chamber encompassed by the cushion chamber comprises any hole which can be created by abrasive erosion at the impact area. Thereby, preferably the portion of the separation chamber encompassed by the cushion chamber has at least the size of the impact area, and a person skilled in the art knows how to take into account suitable design margins to adapt the area encompassed by the cushion chamber so as to maintain a cushion of a previously introduced solids/fluid mixture. For instance, the portion of the separation chamber encompassed by the cushion chamber may extend around the impact area to ensure that cushion chamber encompasses the maximize size hole which may be eroded. This extension in each direction may be for different lengths which are preferably greater than 1 cm, more preferably greater than 2 cm, and most preferably greater than 5 cm more than the shape described by the impact area. The inventors believe there is no upper limit to the extension lengths, but for material conservation reasons, the extension length at a given point from the edge of communication port is measured from the outer point of the communication port to a boundary wall of the cushion chamber along the tangent line, shown in FIG. 6 at 400, which intersects the inlet port vector and is tangent to the outside wall at the edge of the communication port. This extension length shown in FIG. 6 at 410 is best in the range of 0.1 cm to 500 cm, preferably in the range of 1 cm to 500 cm, with the range of 2 cm to 500 cm even more preferred with 5 cm to 500 cm the most preferred. It should be noted that the extension lengths do not need not be uniform around the perimeter of the communication port. In one embodiment, the portion of the separation chamber encompassed by the cushion chamber does not initially have any opening, and the separation chamber and the cushion chamber are not in fluid communication. Thereby, the solids/fluid mixture does not enter the cushion chamber initially. This situation occurs in the case that the disclosed apparatus is manufactured with a separation chamber having a plain wall at the intersection with the inlet port vector. A communication port between the separation chamber and the cushion chamber will then be formed at the intersection of the inlet port vector and the at least one wall of the separation chamber. As the communication port is automatically realized by operating the disclosed apparatus, it will correspond to the impact area of the solids/fluid mixture on the at least one wall. It is noted that this situation occurs also in the case that the cushion chamber is added as a retro-fit to an existing apparatus for separating a solids/fluid mixture before the wall of the separation chamber is eroded by the solids/fluid mixture, said separation apparatus initially comprising a separation chamber without the cushion chamber.

Figure 9:
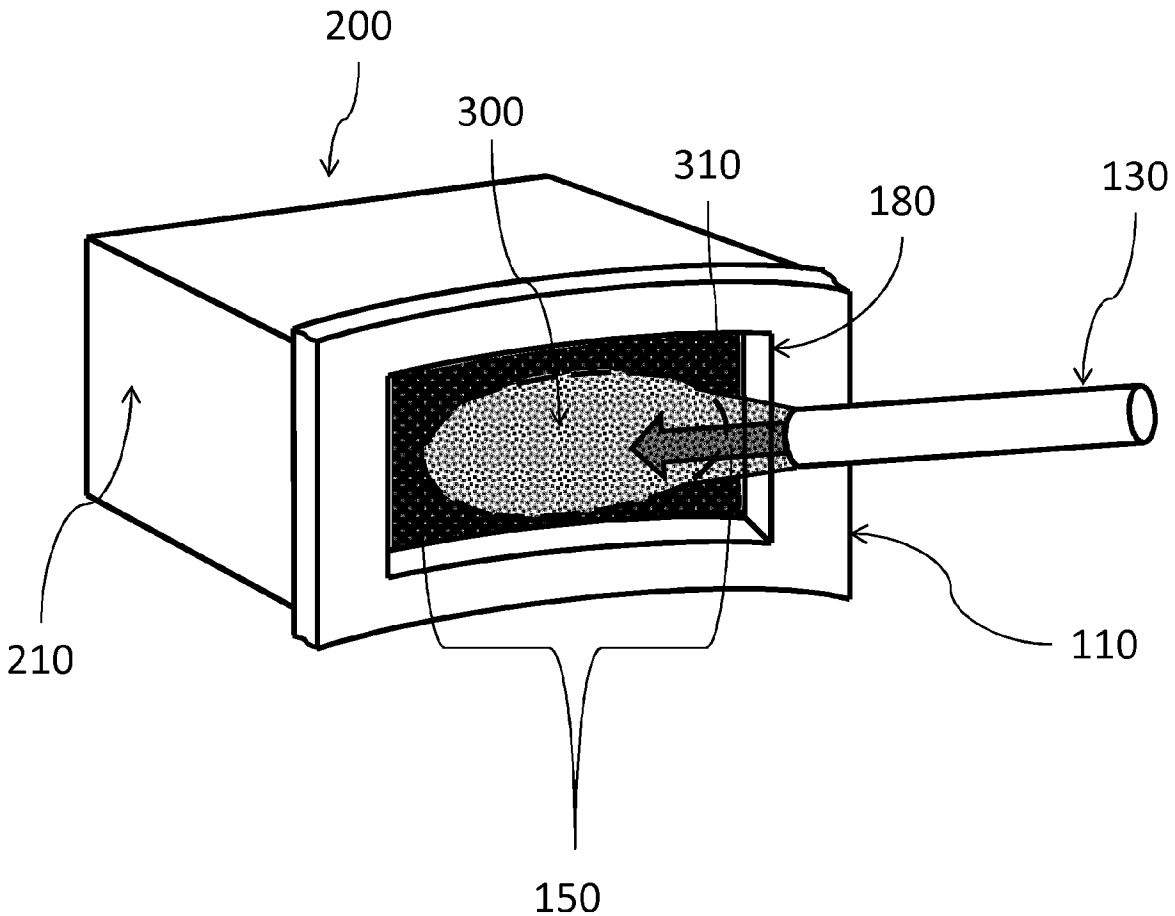
FIG. 9 is a view of the embodiment of the invention from the perspective of looking normal to the inside wall of the separation chamber.

In another embodiment, the communication port between the separation chamber and the cushion chamber encompasses the impact area and it has a size which is greater than the impact area. This typically corresponds to the case when the communication port is manufactured at the intersection of the inlet port vector and the separation chamber and not created by the erosion. FIG. 9 depicts an internal view of the separation chamber, with the communication port (180) having a rectangular shape manufactured on the wall (110) of the separation chamber, encompassing the impact area (150) and elongated in the same direction. The figure also shows the compacted biomass (310) and the plume formed by the solids/fluid mixture (300). In the figure, for clarity it is also shown the cushion chamber (200). It is noted that the boundary walls (210) of the cushion chamber extend beyond the communication port, that is, the width and the height of the cushion chamber are greater than the width and the height of the communication port in the depicted embodiment. The communication port is typically designed taking into account the configuration of the separation chamber and the inlet port vector. The communication port will have a maximum size allowable which depends on its shape, with the provision that the cushion chamber is adapted to maintain a cushion of the solids/fluid mixture at the intersection of the inlet port vector and the cushion chamber. Namely, starting from a communication chamber correspondent to the impact area and progressively enlarging the size of the communication port, the previously introduced solids/fluid mixture will be progressively allowed to escape from the cushion chamber from the zone of the communication port comprised between the impact area and borders of the communication chamber.

As in the case of the cushion chamber, on the basis of the previously disclosed working principle of the cushion chamber, a skilled person may routinely test communication ports having different shapes and sizes, to identify the best working shape and size of the communication port corresponding to a specific configuration, as well as the maximum allowable size of communication port.

Preferably, the communication port is centered on the impact area and has a shape resembling the shape of the impact area. The communication port may have a rectangular shape, elongated in the same direction of the impact area.

In some embodiments, the linear size of the communication port is less than 3 times the maximum size of the impact area, more preferably less than 2 times, and most preferably less than 1.5 times the linear size of the impact area and encompasses the impact area. The linear size of the communication port is the maximum linear distance between any two points at the perimeter of the communication port. Correspondingly, the linear size of the impact area is the maximum linear distance between any two points at the perimeter of the impact area.

In some embodiments, the communication port has an area which is greater than the impact area and less than 5 times the impact area, preferably less than 3 times the impact area, and most preferably less than 2 times the impact area and encompasses the impact area.

In a further embodiment, the communication port is partially manufactured and partially created by erosion of the wall of the separation chamber by the solids/fluid mixture. This embodiment corresponds to the case of a manufactured communication port which is smaller than the impact area, or only partially intercepting the impact area.

In the disclosed apparatus, a communication port between the separation chamber and the cushion chamber may or may not be manufactured at the intersection of the inlet port vector and the separation chamber, provided that a communication port will be realized at a later stage, the communication port being preferably obtained by prolonged erosion at the impact area position.

According to another embodiment of the invention, it is disclosed a process for separating at least one solid from a solids/fluid mixture, wherein the separation process occurs by means and in the apparatus disclosed in the present specification. Thereby, in the disclosed process any of the embodiments of the previously disclosed apparatus may be used.

In the disclosed separation process, the solids/fluid mixture is introduced in the separation apparatus at a mean linear velocity through the inlet port of the separation chamber. The solids/fluid mixture may be introduced through an inlet pipe which is associated to or included in the inlet port. The solids/fluid mixture in the separation chamber may be slightly divergent, forming a sort of plume, thereby the local velocity of the solids/fluid mixture, which is a vector, may be slightly divergent as well. The velocity of the solids/fluid mixture as a whole after entering the separation chamber is represented by a mean velocity vector which is preferably parallel to inlet port vector. It should be noted that the mean velocity vector and an the inlet port vector are on the exact path at the point the solids/fluid mixture exits the inlet port and enters the separation chamber and is free to form the plume. Although the disclosed separation process can separate a solids/fluid mixture with moderate velocity, such as a pulp solids/fluid mixture, the mean velocity is preferably greater than 100 m/s, more preferably greater than 150 m/s, and most preferably greater than 200 m/s. The mean velocity is preferably less than the sound speed in the separation chamber.

After entering the separation chamber, the solids/fluid mixture will travel through the separation chamber to the communication port with the cushion chamber, wherein a cushion of solids/fluid mixture previously introduced in the cushion chamber is maintained at the intersection of the inlet port vector and the cushion chamber. Therefore, the introduced solids/fluid mixture is contacted with the cushion of a previously introduced solids/fluid mixture. It is noted that the contact may happen in the cushion chamber, at the communication port between the cushion chamber and the separation chamber, or in a region of the separation chamber located in proximity of the communication port. Thereby, the incoming solids/fluid mixture and the cushion of the previously introduced solids/fluid mixture are allowed to interact. Without being limited by any theory, it is believed that this interaction is a turbulent flow of previously introduced solids/fluid mixture, such as for instance a vortex flow, which may be established in the cushion chamber or at the communication port, thereby providing a dynamic cushion of solids/fluid mixture which acts as a shield; and/or a static cushion of solids/fluid mixture which is continuously formed in the cushion chamber and removed by the incoming solids/fluid mixture.

As a result of the contact, the velocity of the solids/fluid mixture is greatly reduced and at least a portion of the fluid will be separated from the solids/fluid mixture by density. Again without being limited by any interpretation, the Inventors believe that the solids of the solids/fluid mixture will emerge in the separation chamber with a reduced speed, as evidenced by the lack of erosion on the internal wall of the separation chamber. The separation occurs by the general principle of density difference between the solids and the fluid of the solids/fluid mixture, and different mechanisms may be involved. In one embodiment, the separation occurs under the action of gravity force, with the denser solids being accumulated at the bottom end of the separation chamber, wherein they may be removed from the separation chamber through the optional solids outlet port. At least a portion of the fluid may be removed through the optional fluids outlet port of the separation chamber. If the fluid is steam, and the solids are denser than the steam, then the vapor escapes to the top.

In a preferred embodiment, the solids/fluid mixture is introduced in the separation apparatus in a continuous mode, wherein the flow of the solids/fluid mixture does not need to be time constant and it may be varied over time. In this operating mode, it is believed that a continuous cushion of the solids/fluid mixture is maintained at the intersection of the inlet port vector and the cushion chamber.

In another embodiment, the solids/fluid mixture is introduced in the separation apparatus in a pulsed mode, and there are instants in which no solids/fluid mixture is introduced. A special case of pulsed mode is a cyclic mode, wherein the solids/fluid mixture is introduced for a time interval which is alternate time to stop interval. In this operating mode, it is believed that a cushion of the solids/fluid mixture is maintained at the intersection of the inlet port vector and the cushion chamber for a certain time, after that it will lose effectiveness. Thereby, the pulsed mode is preferably operated at a frequency greater than 1 Hz.

A preferred solids/fluid mixture is a lignocellulosic biomass which has been subjected to a hydrothermal treatment in a pressurized reactor upstream of the separation apparatus. A preferred pretreatment comprises hydrothermally treating the ligno-cellulosic feedstock with water in steam phase in the pressurized reactor, and steam exploding the hydrothermally treated feedstock by rapidly releasing the pressure applied to the feedstock. Optionally, chemical catalysts may also be used or added during the treatment. Examples of chemical catalysts are mineral acids, such as sulfuric acid, or ammonia. The hydrothermal treatment is conducted preferably at a temperature in a range from 130° C. to 230° C. for a time from 1 minute to 1 hours preferably from 1 minute to 20 minutes. The pressurized reactor is preferably pressurized by steam at a pressure of at least 15 bar to obtain an effective breaking-up of the feedstock. The pressurized reactor comprises an outlet connected to the disclosed separation apparatus by means of at least a blow line, or conduit, having an end which is preferably connected to, or associated with, or included in the inlet port. The pressure in the separation chamber is less than the pressure in the pressurized reactor, so that the solids/fluid mixture may flow from the pressurized reactor to the separation apparatus under the action of pressure difference. The pressure in the separation chamber is preferably in a range from 0.5 bar to 4 bar, and most preferably from 1 bar to 2 bar.

In a preferred embodiment, the pressure in the pressurized reactor is preferably at least 8 bar greater than the pressure in the separation chamber, and the pressure applied to the feedstock is suddenly released causing a rapid expansion or explosion of the feedstock cells to create a steam exploded solids/fluid mixture. The steam treated ligno-cellulosic biomass may be steam exploded at the entry in the separation chamber, or along the blow line connecting the pressurized reactor and the inlet port.

Therefore, the fluid of the solids/fluid mixture may comprise water in liquid or vapor phase. Other fluids which may be present in the solids/fluid mixture may be incompressible fluids (liquids) non-condensable gases, compressible gases and other chemical vapors which may include volatile organic compounds.

The invention claimed is:

1. An apparatus for separating at least one solid from a solids/fluid mixture, said apparatus comprising a separation chamber and a cushion chamber, wherein the separation chamber comprises a top end, a bottom end, at least one wall, and an inlet port for introducing the solids/fluid mixture into the separation chamber, said inlet port having an inlet port vector which is the direction at which the solids/fluid mixture enters the separation chamber, wherein the separation chamber and the cushion chamber are connected by a communication port at the intersection of the inlet port vector and the at least one wall of the separation chamber, the cushion chamber comprises at least one boundary wall, and said cushion chamber is adapted to maintain a cushion of the solids/fluid mixture at an intersection of the inlet port vector and the cushion chamber.

2. The apparatus of claim 1, wherein said communication port has an area at least a size of an impact area of the solids/fluid mixture on the at least one wall of the separation chamber in the absence of the communication port.

3. The apparatus of claim 1, wherein at least a portion of the communication port has been created by an erosion of the at least one wall caused by the solids/fluid mixture.

4. The apparatus of claim 1, wherein the communication port has a rectangular shape.

5. The apparatus of claim 1, wherein the inlet port vector has an incidence angle with the at least one wall which is in a range of from greater than 0° and less than 45°.

6. The apparatus of claim 1, wherein the cushion chamber is in the shape of a box comprised of planar boundary walls.

7. The apparatus of claim 1, wherein the cushion chamber has at least one curved boundary wall.

8. The apparatus of claim 1, wherein the solids/fluid mixture is a steam treated lignocellulosic biomass.

9. A process for separating at least one solid from a solids/fluid mixture comprising:

a. introducing the solids/fluid mixture at a mean linear velocity having a mean linear velocity vector through an inlet port of a separation chamber comprised of at least one wall with the separation chamber connected to a cushion chamber through a communication port located at the intersection of the mean linear velocity vector and the at least one wall of the separation chamber, the cushion chamber containing a cushion of a previously introduced solids/fluid mixture, wherein the inlet port vector is the direction at which the solids/fluid mixture enters the separation chamber;

b. contacting the solids/fluid mixture with the cushion of the previously introduced solids/fluid mixture;

c. separating at least a portion of the fluid from the solids/fluid mixture in the separation chamber by density difference.

10. The process of claim 9, wherein the communication port has an area at least a size of an impact area of the solids/fluid mixture on the at least one wall of the separation chamber in the absence of the communication port.

11. The process of claim 9, wherein the communication port has a rectangular shape.

12. The process of claim 9, wherein the mean linear velocity vector has an incidence angle with the separation chamber which is in a range of from greater than 0° to less than 45°.

13. The process of claim 9, wherein the cushion chamber is in the shape of a box comprised of planar boundary walls.

14. The process of claim 9, wherein the cushion chamber has at least one curved boundary wall.

15. The process of claim 9, wherein the mean linear velocity of the solids/fluid mixture is greater than 100 m/s.

16. The process of claim 9, wherein the solids/fluid mixture is introduced in a continuous mode.

17. The process of claim 9, wherein the solids/fluid mixture is introduced in a pulsed mode at a frequency greater than 1 Hz.

18. The process of claim 9, wherein the solids/fluid mixture is steam treated lignocellulosic biomass.

19. The process of claim 9, wherein the inlet port is connected to a pressurized reactor upstream of the separation chamber, and the pressure in the pressurized reactor is at least 8 bar greater than the pressure in the separation chamber.

20. The process of claim 19, further comprising steam exploding the steam treated lignocellulosic biomass.

* * * * *